US006918648B2

(12) United States Patent
Tee et al.

(10) Patent No.: US 6,918,648 B2
(45) Date of Patent: Jul. 19, 2005

(54) INKJET CAPPING ELEVATOR

(75) Inventors: Ah Chong Tee, Singapore (SG); Bee Bee Ang, Singapore (SG); Cherng Linn Teo, Singapore (SG)

(73) Assignee: Hewlett-Packard Development Company, L.P., Houston, TX (US)

( * ) Notice: Subject to any disclaimer, the term of this patent is extended or adjusted under 35 U.S.C. 154(b) by 13 days.

(21) Appl. No.: 10/618,402

(22) Filed: Jul. 11, 2003

(65) Prior Publication Data

US 2005/0007411 A1 Jan. 13, 2005

(51) Int. Cl.[7] ..... B41J 2/165
(52) U.S. Cl. ..... 347/29; 347/32
(58) Field of Search ..... 347/29–36

(56) References Cited

U.S. PATENT DOCUMENTS 5,051,761 A * 9/1991 Fisher et al. ..... 347/30
5,455,609 A * 10/1995 Gast et al. ..... 347/32

* cited by examiner

*Primary Examiner*—Shih-wen Hsieh

(57) ABSTRACT

A printer comprises an inkjet printhead capping assembly that raises up on an elevator to seal the printheads between uses. Such sealing prevents drying of the ink on the printhead nozzles that would otherwise cause clogging and poor operation. The elevator rides up and down on four ramps located at each corner of a cap carriage platform. A rack and pinion gear pushes pins riding on each ramp laterally to translate into the needed up and down elevator motion.

8 Claims, 3 Drawing Sheets

INKJET CAPPING ELEVATOR

FIELD OF THE INVENTION

The present invention relates generally to inkjet printers, and more particularly to inkjet printer capping mechanisms.

BACKGROUND OF THE INVENTION

Various inkjet technologies are employed by printer manufacturers including thermal bubble and piezoelectric. In a thermal inkjet printer, tiny resistors create heat and this heat vaporizes ink to create a bubble. As the bubble expands, some of the ink is expelled from the nozzles onto the print medium. By selectively energizing the resistors as the printhead moves across the print medium, the ink is disposed in a pattern on the print medium to form a desired image. Piezoelectric printers convert electrical energy into physical movement by applying an electrical charge to a piezo crystal located in the back of an ink reservoir associated with each nozzle. Application of an electrical charge causes the crystals to vibrate, thereby forcing ink out of the ink reservoir through the nozzle.

Inkjet printers operate using a printhead comprising a plurality of nozzles which spray ink directly onto a print medium. Typically the printhead is an integral part of the print cartridge, the print cartridge further including an ink reservoir. One or more print cartridges are mounted on a movable print carriage. The print carriage moves laterally across the print medium depositing the ink on the print medium in a pattern to form an image.

When not in use, the printhead nozzles are sealed by a capping assembly. This is to prevent the ink inside the printhead and cartridge from drying out and later contaminating the printhead. Any such clogging of the printhead nozzles can adversely affect print quality.

The capping assembly is typically a stationary apparatus mounted within the printer to one side of the print zone. The printhead is brought into alignment with the capping assembly for sealing of the printheads when the printer is idle.

Since the capping assembly is located outside of the print zone, the minimum width of the printer is the combined width of the print zone and the adjacent capping assembly. The height and width of the printer is an important consideration, particularly in the case of desktop printers since desk space is often limited. It would therefore be advantageous to provide a printer of reduced height and width. Reducing the overall height and width of the printer may provide additional advantages such as reduced weight and lower cost of manufacture.

It is an object of the present invention to provide a capping assembly having a space saving design.

SUMMARY OF THE PRESENT INVENTION

Briefly, a printer embodiment of the present invention comprises an inkjet printhead capping assembly that raises up on an elevator to seal the printheads between uses. Such sealing prevents drying of the ink on the printhead nozzles that would otherwise cause clogging and poor operation. The elevator rides up and down on four ramps located at each corner of a cap carriage platform. A rack and pinion gear pushes pins riding on each ramp laterally to translate into the needed up and down elevator motion.

An advantage of the present invention is that a printer is provided that requires a minimum of space.

DETAILED DESCRIPTION OF THE EMBODIMENTS

Figure 1:
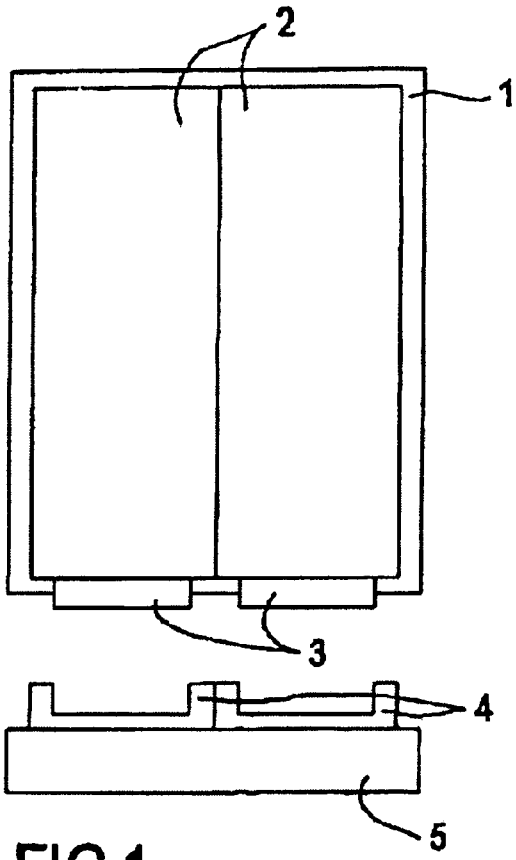
FIG. 1 is a simplified diagram showing a pair of printheads relative to a corresponding pair of sealing caps.

FIG. 1 represents an inkjet printer embodiment of the present invention that comprises an ink cartridge carriage assembly 1, a pair of ink cartridges 2, a pair of printheads 3, a pair of caps 4 to prevent ink drying, and a cap elevator 5. During printing, the printheads 3 spray controlled amounts of ink from the cartridges onto the paper. Afterwards, caps 4 are raised up on an elevator to seal off the printheads to prevent drying of ink in them or on their faces.

Figure 2:
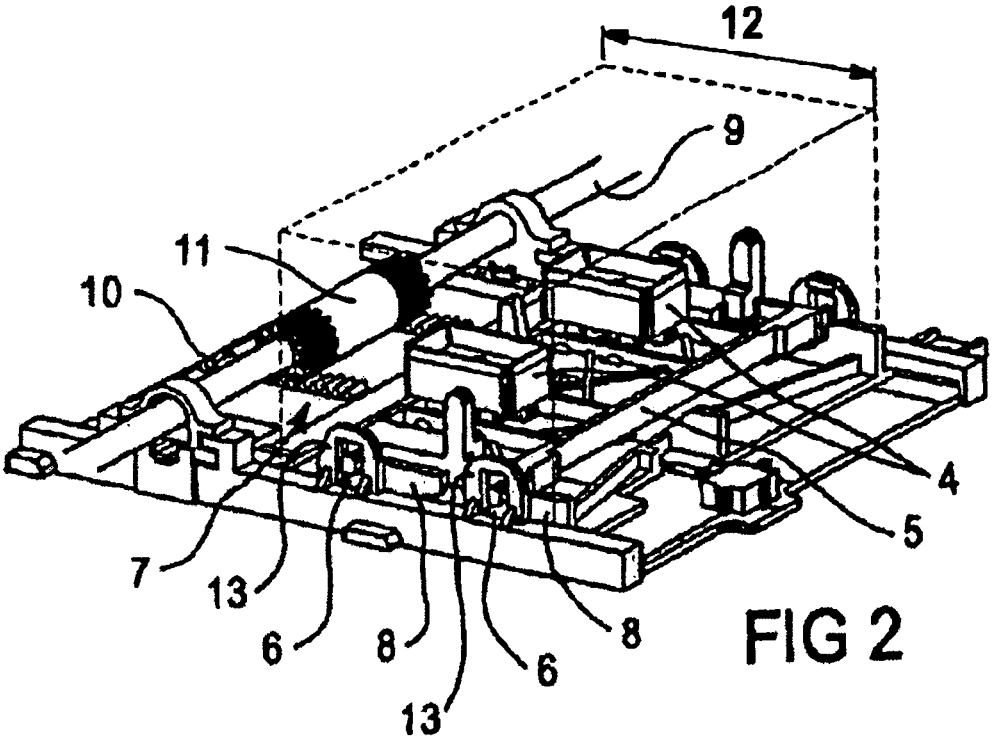
FIG. 2 is a perspective diagram of a portion of a printer embodiment of the present invention, and shows an implementation of the capping elevator and how a rack and pinion gear can be used.
Figure 3:
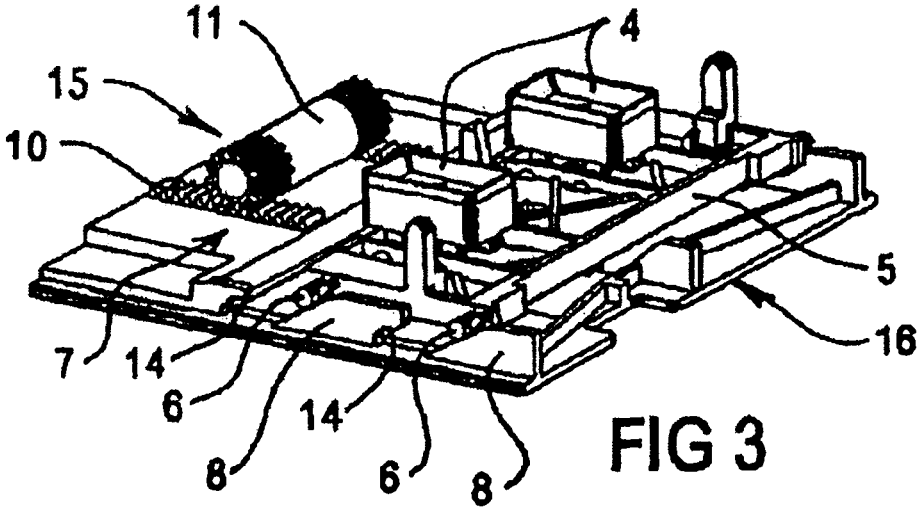
FIG. 3 is another perspective diagram of the printer of FIG. 2, but with the pinion driveshaft and elevator pin guides removed to provide more detail on the parts that were otherwise hidden.

FIGS. 2 and 3 represent a capping assembly embodiment of the present invention that details an implementation over the simplified illustration of FIG. 1. A pair of caps 4 ride on top of a cap-carriage elevator assembly 5. A set of four pins 6 are used to keep the whole in a stationary lateral position while still being able to move up and down. A movable plate 7 with four ramps 8 under each pin 6 can be moved back and forth by a rotating driveshaft 9, and a rack gear 10 engaged with a drive pinion 11. The cap-carriage elevator assembly 5 moves up and down in a capping zone 12. The pins 6 are slotted into four corresponding vertical guides 13 which allow limited movement of the cap-carriage elevator assembly 5. A set of four hooks 14 respectively capture pins 6 and lock down the cap-carriage elevator assembly 5, e.g., during printing. In this position the movable plate is forward away from a rear area 15.

Figure 4A:
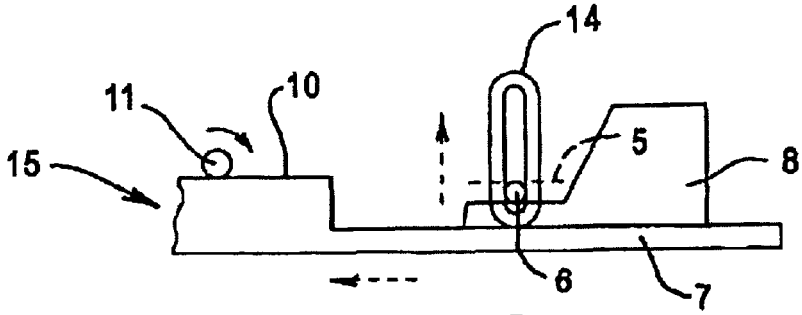
FIGS. 4*a*, 4*b*, and 4*c*, diagram a sequence in which the capping elevator attached to four pins is forced up by the interaction of corresponding ramps and pin guides. The pinion shaft is shown turning clockwise.
Figure 4B:
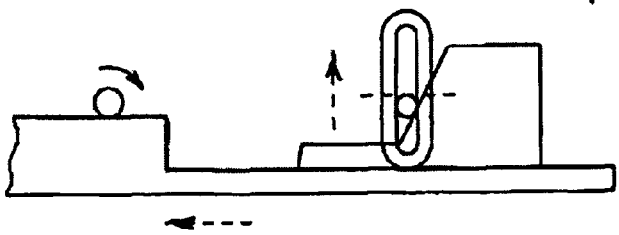
Figure 4C:
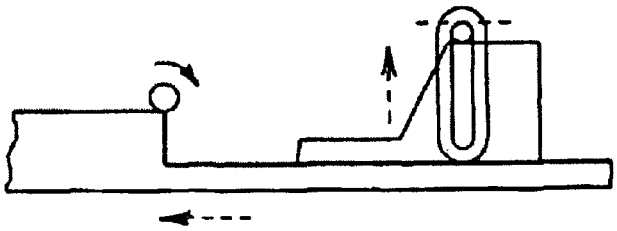

FIGS. 4A, 4B, and 4C, show the lifting of the cap-carriage elevator assembly 5 from its lowest position, FIG. 4A, its intermediate elevation, FIG. 4B, and its highest elevation, FIG. 4C. There are at each corner of the movable plate 7 and cap-carriage elevator assembly 5, four corresponding sets of pins 6, guides 14, and ramps 8. The pinion 11 is shown turning clockwise against rack gear 10 and that draws the movable plate 7 toward the rear area 15.

Figure 5A:
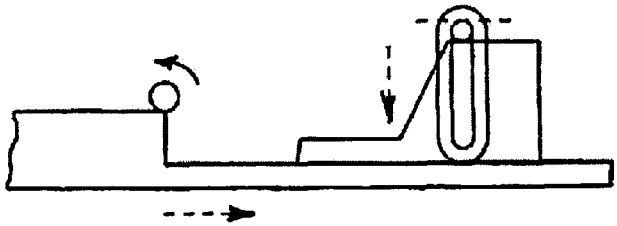
FIGS. 5*a*, 5*b*, and 5*c*, diagram an opposite sequence in which the capping elevator attached to four pins is brought back down by the interaction of corresponding ramps and pin guides. The pinion shaft is shown turning counter-clockwise.
Figure 5B:
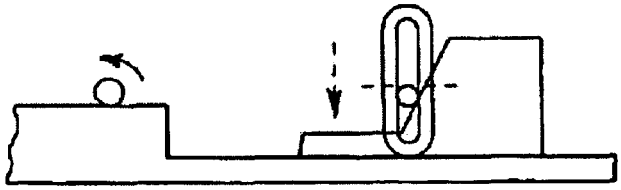
Figure 5C:
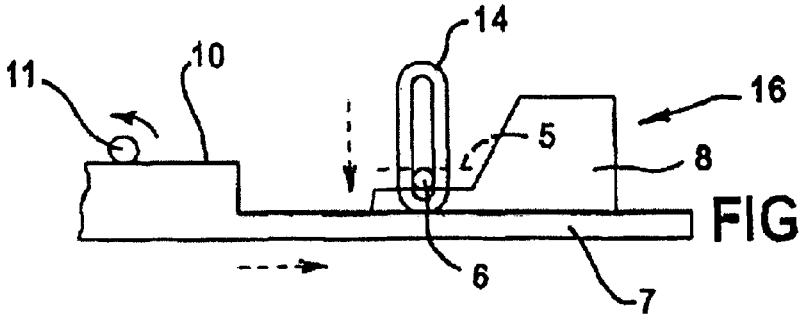

Conversely, FIGS. 5A, 5B, and 5C, show the dropping back down of the cap-carriage elevator assembly 5 from its highest position, FIG. 5A, its intermediate elevation, FIG. 5B, and its lowest elevation, FIG. 5C. Again, there are at each corner of the movable plate 7 and cap-carriage elevator assembly 5, four corresponding sets of pins 6, guides 14, and ramps 8. The pinion 11 is shown turning counter-clockwise against rack gear 10 and that pushes the movable plate 7 away from the rear area 15.

Figure 6:
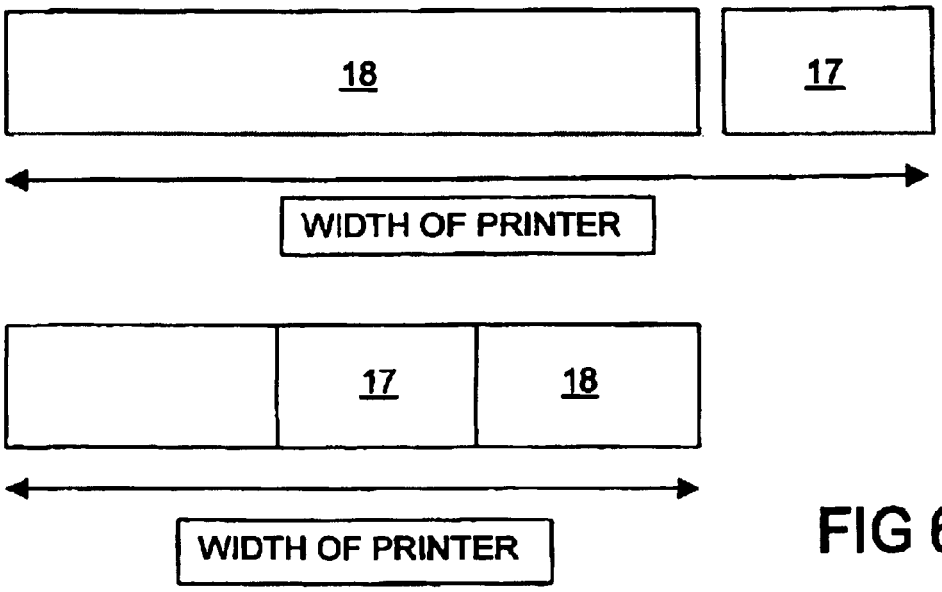
FIG. 6 is a diagram that demonstrates how printer embodiments of the present invention can be made much narrower in overall width because the capping station is within the printing area.

FIG. 6 is a diagram representing the difference in width over conventional printer mechanism layouts. The capping assembly 17 is typically disposed in prior art printers to one side of the print zone 18, thus making it wider overall. The print zone 18 corresponds approximately with to the width of the print medium. The width of prior art inkjet printers is typically a combination of the width of the print zone 18 and the adjacently disposed capping assembly 17. In order to minimize the width of the printer, the capping assembly 17 is positioned within the print zone 18 of the printer. Positioning of the capping assembly 17 within the print zone 18 allows the width of the printer to be significantly reduced.

While some embodiments of the present invention have been illustrated here in detail, it should be apparent that modifications and adaptations to these embodiments may occur to one skilled in the art without departing from the scope of the present invention as set forth in the following claims.

We claim:

1. A printer, comprising:

an inkjet printhead for printing ink;

a cap proximate to the inkjet printhead and providing for a sealing of it to prevent drying of unused ink; and an elevator connected to the cap and occupying an area within a printing zone of the inkjet printhead, said elevator providing for movement of the cap away from the printhead to allow printing, and allowing for movement to the printhead to allow for sealing and the preventing of ink drying, wherein the elevator is operable to move up and down by drawing a movable platform along a set of ramps.

2. The printer of claim 1, wherein:

the elevator includes locks to hold it in its down and away position during printing.

3. The printer of claim 1, further comprising:

a rack and pinion gear connected to translate a driveshaft rotation into a lateral motion of a movable plate disposed within the elevator.

4. The printer of claim 3, further comprising:

a set of corner pins and ramps connected to translate said lateral motion of said movable plate into an up and down motion of the elevator.

5. A method of printing, comprising:

providing an inkjet printhead for printing ink;

locating a cap proximate to the inkjet printhead and using it for a seal to prevent drying of unused ink; and operating an elevator connected to the cap for movement of the cap away from the printhead to allow printing, and for movement toward the printhead to allow for sealing and the preventing of ink drying, wherein the operating of the elevator occupies an area within a printing zone of the inkjet printhead, thereby providing for a narrower overall width, and the operating of the elevator is such that it derives its up and down movement by drawing a movable platform along a set of ramps.

6. The method of claim 5, wherein:

the operating of the elevator includes locking it to hold its down and away position during printing.

7. The method of claim 5, further comprising:

using a rack and pinion gear to translate a driveshaft rotation into a lateral motion of a movable plate disposed within the elevator.

8. The method of claim 7, further comprising:

using a set of corner pins and ramps to translate said lateral motion of said movable plate into an up and down motion of the elevator.

* * * * *